US009873203B2

(12) United States Patent
Stapelbroek et al.

(10) Patent No.: US 9,873,203 B2
(45) Date of Patent: Jan. 23, 2018

(54) BLADE SET FOR HAIR CUTTING APPLIANCE AND METHOD FOR ITS MANUFACTURE

(71) Applicant: KONINKLIJKE PHILIPS N.V., Eindhoven (NL)

(72) Inventors: Martinus Bernardus Stapelbroek, Eindhoven (NL); Jan Van Dalen, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 307 days.

(21) Appl. No.: 14/387,862

(22) PCT Filed: Mar. 26, 2013

(86) PCT No.: PCT/IB2013/052379

§ 371 (c)(1),
(2) Date: Sep. 25, 2014

(87) PCT Pub. No.: WO2013/150412

PCT Pub. Date: Oct. 10, 2013

(65) Prior Publication Data

US 2015/0047203 A1 Feb. 19, 2015

(30) Foreign Application Priority Data

Apr. 3, 2012 (EP) ..... 12162928

(51) Int. Cl.
*B26B 21/44* (2006.01)
*B26B 21/06* (2006.01)
(Continued)

(52) U.S. Cl.
CPC ..... *B26B 19/06* (2013.01); *B26B 19/143* (2013.01); *B26B 19/384* (2013.01); *B26B 19/3846* (2013.01); *B26B 19/3893* (2013.01)

(58) Field of Classification Search
CPC ..... B26B 18/143; B26B 18/06; B26B 18/384; B26B 18/3846; B26B 18/3893
USPC ..... 30/45, 50, 43.91, 43.92
See application file for complete search history.

(56) References Cited

U.S. PATENT DOCUMENTS 2,035,632 A 3/1936 Andis
2,102,529 A 12/1937 Hanley
(Continued)

FOREIGN PATENT DOCUMENTS

CH 496523 A 9/1970
DE 2026509 A1 12/1970
(Continued)

*Primary Examiner* — Omar Flores Sanchez

(57) ABSTRACT

A stationary blade for a blade set of an electrically operated hair cutting appliance includes first and second walls, where each wall has a first surface, a second surface facing away from the first surface, and a laterally extending leading edge having a plurality of laterally spaced apart longitudinally extending projections. The first surfaces of the first and second walls face each other, at least at their leading edges, while corresponding projections along the leading edges of the first and second walls are mutually connected at their tips to define a plurality of generally U-shaped teeth. The first surfaces of the first and second walls are separated to define a laterally extending guide slot for insertion of a movable blade of the blade set between them. The projections of the first wall have an average thickness that is less than an average thickness of the projections of the second wall.

5 Claims, 6 Drawing Sheets

(51) Int. Cl.

| | |
|---|---|
| ***B26B 19/06*** | (2006.01) |
| ***B26B 19/14*** | (2006.01) |
| ***B26B 19/38*** | (2006.01) |

(56) References Cited

U.S. PATENT DOCUMENTS

| | | | | | |
|---|---|---|---|---|---|
| 2,151,965 | A | * | 3/1939 | Hanley | B26B 19/042<br>30/346.51 |
| 2,222,106 | A | * | 11/1940 | Knapp | B26B 19/042<br>30/43.92 |
| 2,222,107 | A | * | 11/1940 | Knapp | B26B 19/04<br>30/346.51 |
| 2,426,412 | A | * | 8/1947 | Pinkas | B26B 19/38<br>30/41.6 |
| 2,573,758 | A | * | 11/1951 | Bailey | B26B 19/10<br>30/346.51 |
| 4,724,614 | A | | 2/1988 | Wahl | |
| 5,893,211 | A | | 4/1999 | Hotani | |
| 2009/0126201 | A1 | | 5/2009 | Melton | |
| 2011/0119929 | A1 | | 5/2011 | Lau | |
| 2011/0167639 | A1 | | 7/2011 | Lau | |

FOREIGN PATENT DOCUMENTS

| | | | |
|---|---|---|---|
| EP | 2085195 | A1 | 8/2009 |
| JP | 61124281 | U | 8/1986 |
| JP | 2002369980 | A | 12/2002 |
| JP | 2003053063 | A | 2/2003 |
| WO | 2009024900 | A1 | 2/2009 |
| WO | 2011098864 | A1 | 8/2011 |

* cited by examiner

BLADE SET FOR HAIR CUTTING APPLIANCE AND METHOD FOR ITS MANUFACTURE

This application is the U.S. National Phase application under 35 U.S.C. §371 of International Application No. PCT/IB2013/052379, filed on Mar. 26, 2013, which claims the benefit of European Application No. 12162928.1 filed on Apr. 3, 2012. These applications are hereby incorporated by reference herein.

FIELD OF THE INVENTION

The present invention relates to an electrically operated hair cutting appliance, and more particularly to a blade set, including both a stationary blade and a movable blade, for such an appliance. The present invention also relates to a method for the manufacture of the blade set, in particular the stationary blade thereof.

BACKGROUND OF THE INVENTION

For the purpose of cutting body hair there are two customarily distinguished types of electrically powered appliances: the razor, and the hair trimmer or clipper. Where the razor is used for shaving, i.e. slicing body hairs at the level of the skin to as to obtain a smooth skin without stubbles, the hair trimmer is used to sever the hairs at a chosen distance from the skin, i.e. for cutting the hairs to a desired length. The difference in application is reflected by the different architectures of the cutting blade arrangement implemented on either appliance.

An electric razor typically includes a foil, i.e. an ultra thin perforated screen, and a cutter blade that is movable along the inside of the foil. During use, the outside of the foil is placed against the skin, such that any hairs that penetrate the foil are cut off by the cutter blade that moves against the inside thereof and fall into hollow hair collection portions inside the razor. An electric hair trimmer, on the other hand, typically includes two generally planar cutter blades with a toothed edge, one placed on top of the other such that the toothed edges overlap. In operation, the cutter blades reciprocate relative to each other, cutting off any hairs that are trapped between their teeth in a scissor action. The precise level above the skin at which the hairs are cut off is normally determined by means of an attachment, called a (spacer) guard or comb.

SUMMARY OF THE INVENTION

Unfortunately, electric razors are not suitable for cutting hair to a desired variable length above the skin. This is in part due to the fact that they include no mechanism for spacing the foil from the skin. But even if they did, the configuration of the foil, which typically involves a large number of tiny closed-circumference perforations, would frustrate the efficient capture of all but the shortest and stiffest of hairs. Similarly, hair trimmers are not suitable for shaving, primarily because the separate cutter blades require a certain rigidity, and therefore thickness, to perform the scissor action without deforming. It is the minimum required blade thickness that prevents hair from being cut off close to the skin. Consequently, a user desiring to both shave and trim his body hair may need to resort to two appliances.

An example of a conventional hair trimmer can be found in DE 2 026 509. The cutting head disclosed in DE'509 includes a tube-shaped housing with an acutely folded, outwardly extending protrusion including teeth, and a U-shaped movable blade having at least one outwardly bent leg provided with a serrated edge. The movable blade is received within the folded protrusion for reciprocating linear motion therein. Both the stationary and the movable blade may be made from thin, rolled steel, which renders them fragile. To stiffen the blades, DE'509 seems to suggests the use of bent reinforcing connectors between extremities of a respective blade.

It is an object of the present invention to provide for an alternative robust blade set, and in particular for a stationary blade thereof, that enables both shaving and trimming.

To this end, a first aspect of the present invention is directed to a stationary blade for a blade set of an electrically operated hair cutting appliance. The stationary blade may include a first wall and a second wall. Each wall may define a first surface, a second surface facing away from the first surface, and a laterally extending (toothed, comb-like) leading edge defining a plurality of laterally spaced apart longitudinally extending projections. The first surfaces of the first and second walls may be arranged to face each other, at least at their leading edges, while facing projections along the leading edges of the first and second walls may be mutually connected at their tips to define a plurality of generally U-shaped teeth, such that the first surfaces of the first and second walls define a laterally extending guide slot for a movable blade of said blade set between them. The projections of the first wall may have an average thickness that is less than an average thickness of the projections (34) of the second wall (30).

The presently disclosed stationary blade may be essentially U-shaped, having a first, skin-contacting wall and a second, supporting wall. The walls may extend oppositely and generally parallel to each other, and be connected to each other along a leading edge under the formation of a series of spaced apart, U-shaped (i.e. double-walled) teeth. The overall U-shape of the stationary blade, and more in particular the U-shape of the teeth, reinforces the structure of the stationary blade. The fact that the projections of the second, supporting wall have a greater average thickness than the projections of the first wall, strengthens the stationary blade further. Especially the structural strength of the teeth is improved compared to a conventional simple planar cutter blade of a hair trimmer. This allows the first, skin-contacting wall of the stationary blade according to the present invention to be made significantly thinner than conventional hair trimmer cutter blades, so thin in fact, that its thickness may approach that of a razor foil. At the same time, the stationary blade retains the open-circumference spacings between the teeth, which enable it to efficiently capture longer hairs. The stationary blade thus offers the best of the two different cutter blade architectures found on razors and hair trimmers, and accordingly enables the construction of a blade set suitable for both shaving and trimming.

An average thickness of the second wall may preferably be greater than 100 μm, e.g. be in the range of 100 μm-200 μm. In a preferred embodiment, the ratio between an average wall/projections thickness of the second wall and an average wall/projections thickness of the first wall may be at least 3:2, and more preferably 2:1.

As regards the geometry of the stationary blade and the terminology used in this text to describe it, the following may be noted. Different embodiments of the stationary blade may have different geometries. In one embodiment, for instance, the stationary blade may have a linear geometry (see FIGS. 1-8). In such an embodiment, the 'laterally extending guide slot' may extend linearly, while the 'longitudinally extending projections' provided along the linear leading edges of the first and second walls of the stationary blade may extend substantially in parallel, and perpendicular to the linear edges. In an alternative embodiment, the stationary blade may have a curved, in particular circular geometry (see FIGS. 9-10). In such an embodiment, the 'laterally extending guide slot' may extend tangentially around a central axis along an elliptically, in particular circularly, curved path, while the laterally adjacent 'longitudinally extending projections' provided along the circularly curved leading edges of the first and second walls of the stationary blade may extend in a radial direction relative to the central axis (thus not being mutually parallel). Accordingly, the term 'lateral' should not be construed to relate to linear geometry only; in a circular geometry, for instance, the term may be synonymous with the term 'tangential'. The term 'longitudinal' may generally refer to a direction perpendicular to a lateral direction; in the case of circular geometry, the term may thus be synonymous with the term 'radial'.

In one embodiment of the stationary blade, the first wall, or at least the projections thereof, may have an average thickness less than 200 μm, and preferably less than 100 μm. The thinner the projections of the first, skin-contacting wall, the closer to the skin a user may shave with it.

In another embodiment the first wall, or at least the portion thereof defining its projections, may be substantially planar, such that all projections of the first wall extend in substantially the same plane. This may enable the leading portion of the first wall to be laid flat against especially large patches of skin, optimizing the area at which hair may be cut. In an alternative embodiment, the first wall, or at least the portion thereof defining its projections, may be convexly curved as seen in a cross-sectional plane perpendicular to the lateral direction. During use, when the skin-contacting second surface is pressed against the flexible skin, the convex curvature of the second surface of the first wall may provide for a more equal and therefore more comfortable pressure distribution across the skin than a planar second surface. This is in part because the convex curvature prevents high skin strain levels at the circumferential edge of the first wall as it avoids the necessity for the skin to bulge out from under this edge.

As the first and second walls may themselves be relatively thin, and the spacing between them may be relatively small, the teeth along the leading edge of the stationary blade may be perceived as sharp. To prevent cutting of the skin, the teeth in one embodiment of the stationary blade may be provided with a rounded or convexly curved tip, as seen in a longitudinal cross-section. A minimum radius of curvature of the tip of a tooth may preferably be about 0.3 mm.

In one embodiment of the stationary blade, the effective structural strength of the blade, including its teeth, may be enhanced by mutually connecting the first and second walls by means of at least one discrete connector portion that extends between their first, facing surfaces. The connector portion may act both as a spacer that prevents the first wall from being pushed against the second wall, and as an anchor that prevents the first wall from moving or deforming relative to the second wall in the lateral and/or longitudinal direction.

In a further embodiment, an average overall thickness of the stationary blade, measured between the second surfaces of the first and second walls at their projections, may preferably be less than 1 mm, and more preferably less than 0.6 mm. A small overall thickness helps to warrant proper hair catching efficiency, in particular when trimming longer hairs. More specifically, it ensures that a small area of contact exists between the leading edge of the stationary blade and the hairs, which assists in bending the hairs into between the laterally spaced apart U-shaped teeth rather than pushing them flat and away.

A second aspect of the present invention is directed to a blade set for a hair cutting appliance. The blade set may include a stationary blade according to the first aspect of the present invention, and a movable blade with a toothed leading edge. The movable blade may be laterally movably arranged within the guide slot defined by the stationary blade, such that, upon lateral reciprocation of the movable blade relative to the stationary blade, the toothed leading edge of the movable blade cooperates with the teeth of the stationary blade to enable cutting of hair caught therebetween in a scissor action.

A third aspect of the present invention is directed to a hair cutting appliance. The hair cutting appliance may include a housing that accommodates an electric motor. It may also include a blade set according to the second aspect of the present invention. The stationary blade of the blade set may be fixedly connected to the housing, while the movable blade may be operably connected to the electric motor, such that the motor is capable of laterally reciprocating the movable blade within in the guide slot of the stationary blade.

A fourth aspect of the present invention is directed to a method of manufacturing a stationary blade of a hair cutting appliance. The method may include providing a first metal plate with a first laterally extending leading edge; providing a second metal plate having a second laterally extending leading edge; and providing a metal strip having a lateral dimension that corresponds to that of the leading edges of the first and second metal plates and a longitudinal dimension that is significantly smaller than that of the first and second metal plates. The method may further include stacking the second metal plate on top of the first metal plate while arranging the metal strip in between their leading edges, such that a longitudinal cross-section of the stacked arrangement is generally U-shaped; fixing the stacked arrangement by welding the strip between the first and second leading edges; and creating discrete U-shaped teeth by machining a plurality of laterally spaced apart slots into the leading edge of the arrangement, such that said slots extend longitudinally beyond the strip. In this context, the term 'machining' is intended to be construed broadly, and may be regarded to include any 'subtractive manufacturing process', such as, for instance, milling or wire-eroding.

An advantage of the method according to the fourth aspect of the present invention is that it facilitates the manufacture of a stationary blade having first and second walls of a different (average) thickness. Moreover, it conveniently allows for the fabrication of stationary blades having a curved, for instance circular, geometry. Accordingly, the method of manufacture according to the fourth aspect of the invention improves upon an alternative method of manufacture involving the steps of providing a metal plate; stamping a plurality of substantially identical, longitudinally extending, laterally spaced apart slots into the plate; and folding the plate into a U-shape along a laterally extending fold-line that extends through said spaced apart slots. Although this latter method is well suited for the manufacture of a stationary blade including first and second walls of equal thickness and having a linear geometry, it is less suitable for the manufacture of a stationary blade including first and second walls of a different thickness, and practically unusable for the manufacture of a stationary blade having a curved geometry.

These and other features and advantages of the invention will be more fully understood from the following detailed description of certain embodiments of the invention, taken together with the accompanying drawings, which are meant to illustrate and not to limit the invention.

DETAILED DESCRIPTION

Figure 1:
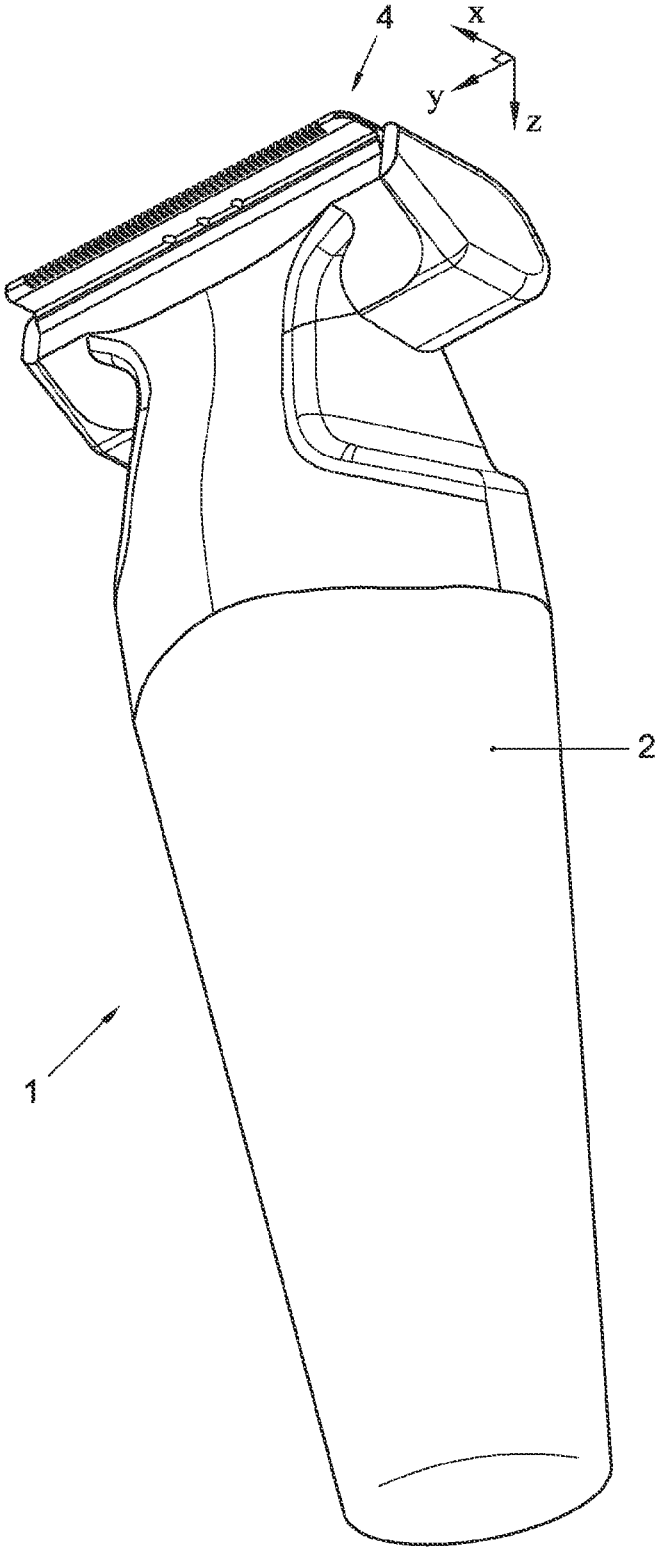
FIG. 1 is a schematic perspective view of an electric hair cutting appliance fitted with an exemplary embodiment of a blade set according to the present disclosure.
Figure 2A:
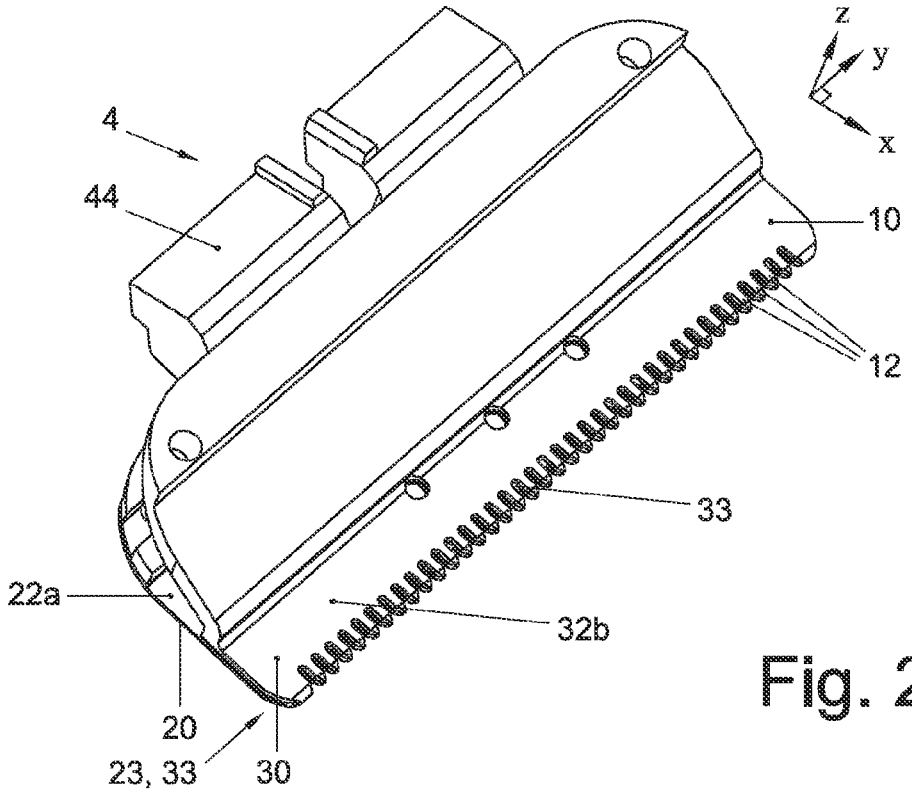
FIG. 2A is a schematic perspective top view of the blade set shown in FIG. 1, comprising a stationary blade and a movable blade.
Figure 2B:
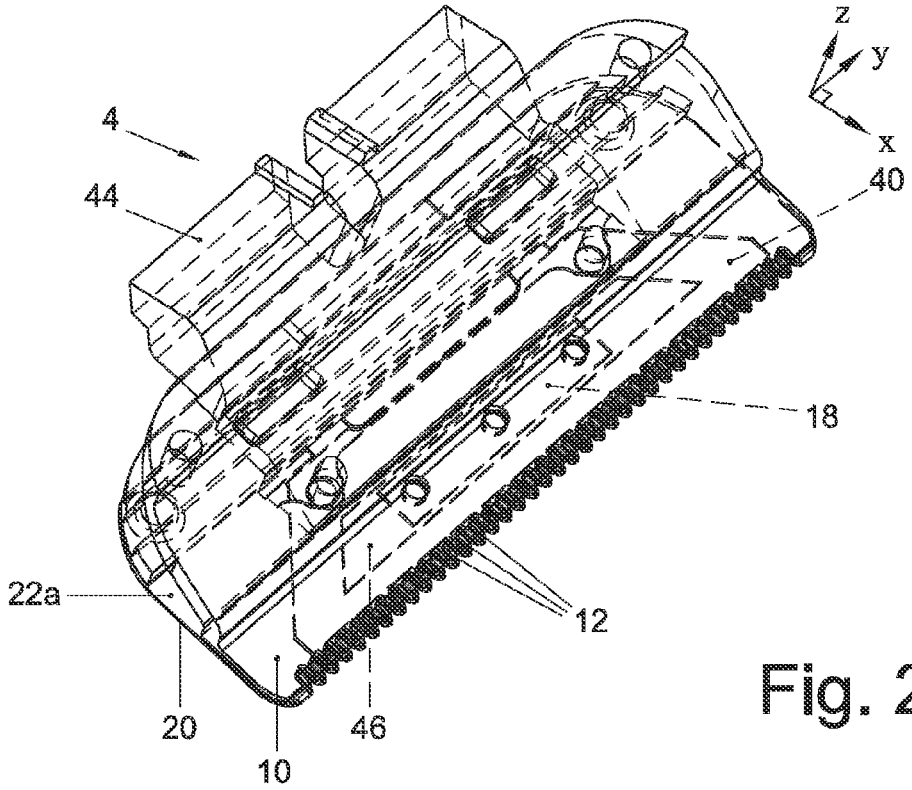
FIG. 2B is a schematic perspective top view of the blade set shown in FIG. 2A, indicating hidden lines to illustrate the placement of the movable blade within the guide slot of the stationary blade.
Figure 3:
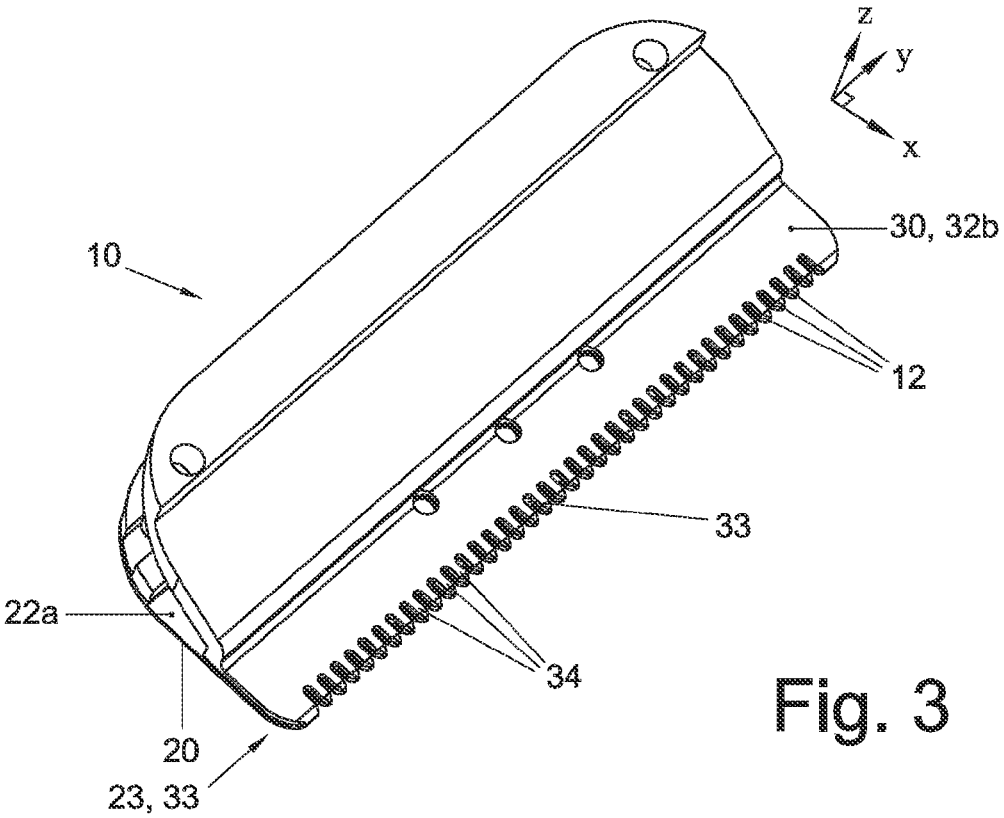
FIG. 3 is a schematic perspective top view of the stationary blade of the blade set shown in FIG. 2.
Figure 4:
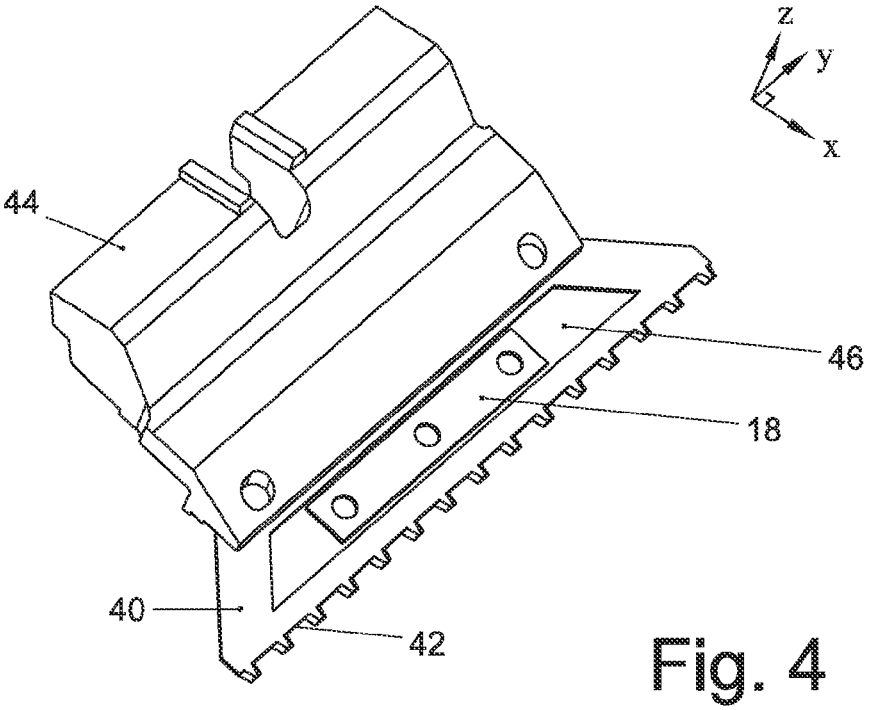
FIG. 4 is a schematic perspective top view of the movable blade, and a connector portion of the stationary blade, of the blade set shown in FIG. 2.
Figure 5:
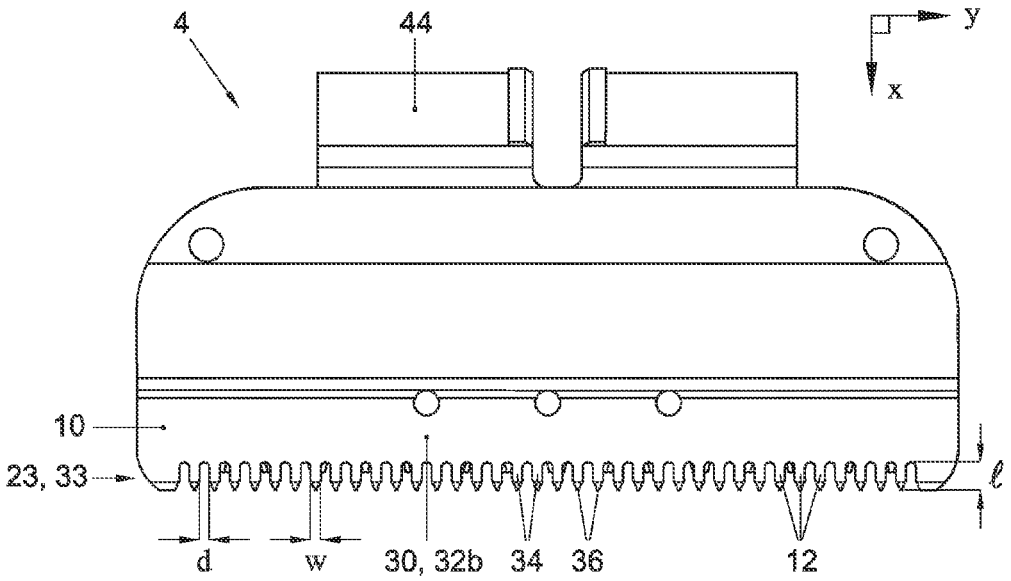
FIG. 5 is top view of the blade set shown in FIG. 2.
Figure 6:
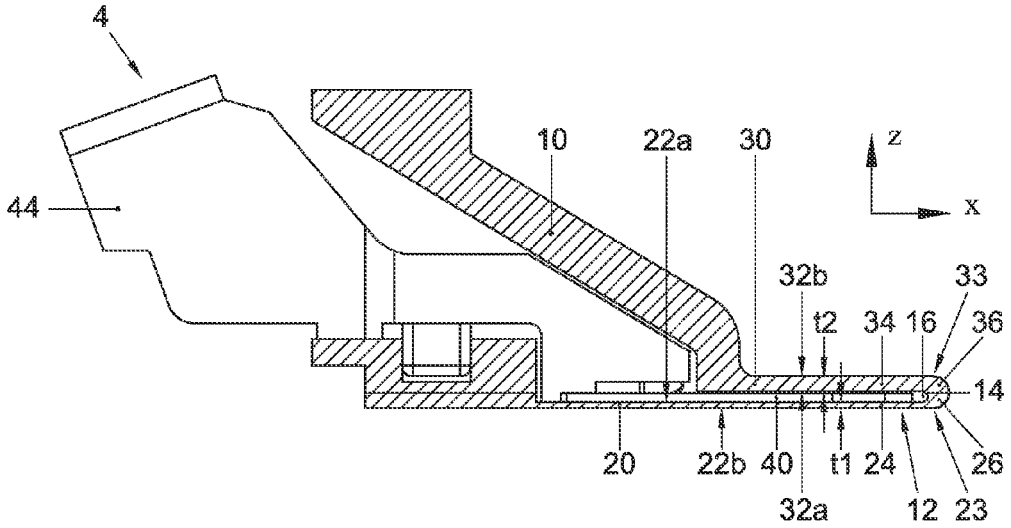
FIG. 6 is a cross-sectional side view of the blade set shown in FIG. 2.

FIG. 1 schematically illustrates, in a perspective view, an exemplary embodiment of an electric hair cutting appliance 1 according to the present disclosure. The appliance 1 may include a housing 2, an electric battery, an electric motor, and a blade set 4. The housing 2 may accommodate the electric battery and the electric motor, which may be operably connected so that the motor is powerable from the battery. The blade set 4, which is shown in more detail in FIGS. 2-6, may include a stationary blade 10 that is fixedly connected to the housing 2, and a movable blade 40 that is connected to the motor such that it is movable in a laterally reciprocating motion relative to the stationary blade 10. Apart from the blade set 4, the hair cutting appliance 1 may generally be known in the art.

For ease of reference, a Cartesian coordinate system is indicated in each of the FIGS. 1-6. The x-as of the coordinate system extends in the longitudinal direction associated with length, the y-axis extends in the lateral direction associated with width, and the z-direction extends in the direction associated with height or thickness.

Referring now to in particular FIGS. 2-6, which illustrate the blade set 4 of FIG. 1 in various perspective top, orthogonal top and cross-sectional side views.

The stationary blade 10 of the blade set 4 may include a first wall 20 and a second wall 30. The walls 20, 30 may be generally plate-like, but need not be. Each wall 20, 30 may define a first surface 22*a*, 32*a*, a second surface 22*b*, 32*b* facing away from the first surface 22*a*, 32*a*, and a laterally extending leading edge 23, 33 defining a plurality of laterally spaced apart, generally longitudinally extending projections 24, 34. The first and second walls 20, 30 may be arranged in a spaced apart relationship, such that the first surfaces 22*a*, 32*a* face each other. The projections 24, 34 of the leading edges of the first and second walls 20, 30 may preferably be in a one-to-one relationship, wherein each projection 24 of the plurality of projections on the first wall 20 is associated with a facing or opposite projection 34 of the plurality of projections on the second wall 30. The associated projections 24, 34 may be connected at their tips 26, 36, thus forming a plurality of laterally spaced apart, longitudinally extending, generally U-shaped (i.e. double-walled) teeth 12. The first and second walls 20, 30, including the U-shaped teeth 12 they define—or more specifically: the first, inner surfaces 22*a*, 32*a* of the first and second walls 20, 30, including first surface portions provided by the projections 24, 34 thereof—may define a laterally extending guide slot 16 for the movable blade 40 of the blade set 4 between them.

The first and second walls 20, 30 of the stationary blade 10 may have different functions. The first wall 20 may serve as a foil that, in operation, may be disposed between the skin of a user and the movable blade 40, so as to prevent the former from direct contact with the latter. To enable body hairs to be cut off at or very close to skin level, the first wall 20, or at least the portion thereof providing for the projections 24, may preferably have the smallest practicable average thickness, which may at least be less than 100 μm. The second wall's 30 purpose may be to provide the ultra thin first wall 20 with sufficient rigidity against deformations during use. Aside from the structural support provided to the first wall through the plurality of U-shaped tooth 12 connections, two features are proposed to enhance the effective structural strength of the stationary blade: connector portions 18 and a relatively thick second wall 30.

In one embodiment, the first and second walls 20, 30 may be mutually connected by at least one discrete connector portion 18 that extends between their respective first surfaces 22*a*, 32*a*. The connector portion 18 may act both as a spacer that prevents the first wall 20 from being pushed against the second wall 30, and as an anchor that prevents the first wall 20 from moving/deforming relative to the second wall 30 in the lateral (y) and/or longitudinal (x) direction. In principle, a connector portion 18 may be disposed anywhere between the first surfaces 22*a*, 32*a* of the first and second walls 20, 30; it is, however, preferably not disposed between the projections 24, 34 that define the U-shaped teeth 12. In one embodiment, a connector portion 18 may be disposed at a lateral extremity of the guide slot 16, so as to prevent it from interfering with the movable blade 40 that is to laterally reciprocate within that slot. In another embodiment, such as the one shown in FIGS. 1-6, a connector portion 18 may be disposed at a position between the lateral extremities of the guide slot 16, and correspond to a laterally extending guide or cam slot 46 provided in the movable blade 40, such that the connector portion 18 may also serve as a guide cam for the movable blade 40.

In another embodiment, the first wall 20 may be effectively strengthened by providing the second wall 30, or at least its projections 34, with an average thickness $t_2$ that is greater than an average thickness $t_1$ of the first wall 20, or at least of the projections 24 thereof. An average thickness $t_2$ of the second wall 30 may preferably be greater than 100 μm, e.g. be in the range of 100 μm-200 μm. In a preferred embodiment, the ratio $t_2$:$t_1$ between an average wall thickness $t_2$ of the second wall 30 and an average wall thickness $t_1$ of the first wall 20 may be at least 3:2, and more preferably 2:1.—It is noted explicitly that not all embodiments of the presently disclosed stationary blade need to include a second wall 30, or second wall projections 34, having an average thickness $t_2$ that is greater than an average thickness $t_1$ of the first wall 20, or the first wall projections 24, even though such embodiments may not be covered by the presently attached claims. An overall average thickness or height of the stationary blade 10, and in particular the U-teethed leading edge thereof, wherein thickness or height is understood to be the distance between its second surfaces 22*b*, 32*b*, may preferably be less than about 1 mm. A small thickness helps to warrant proper hair catching efficiency, in particular when trimming longer hairs. More specifically, it ensures that a small area of contact exists between the leading edge of the stationary blade and the hairs, which assists in bending the hairs into between the laterally spaced U-shaped teeth rather than pushing them flat and away.

Figure 7:
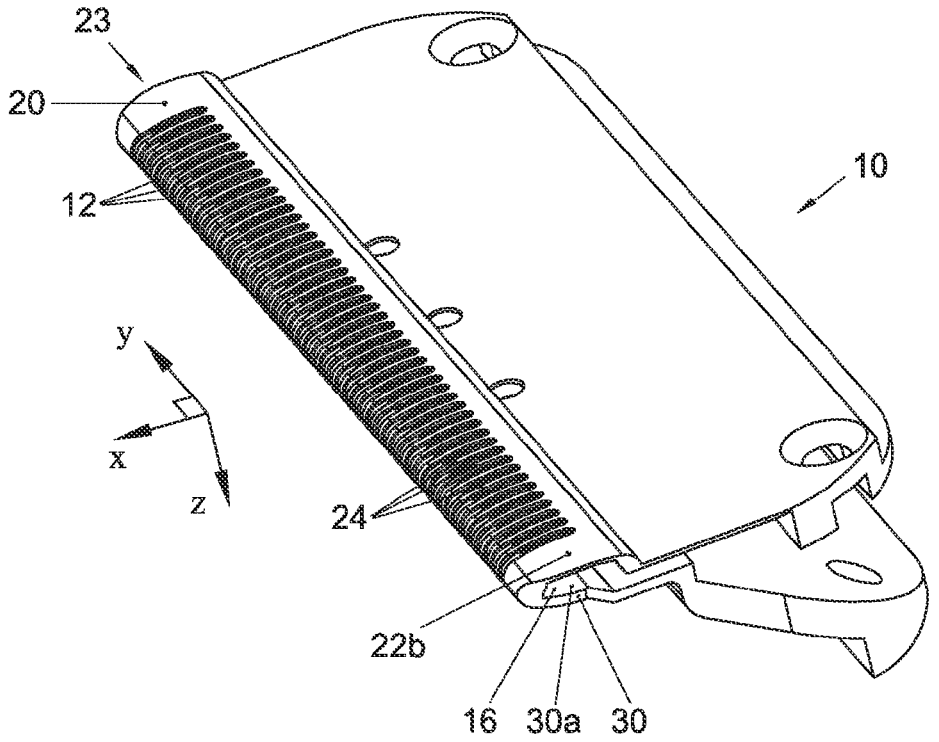
FIG. 7 is a schematic perspective bottom view of an alternative exemplary embodiment of a stationary blade, differing from the stationary blade of the blade set of FIGS. 1-7 in that it features longer U-shaped teeth and a convexly curved first, skin-contacting wall.
Figure 8:
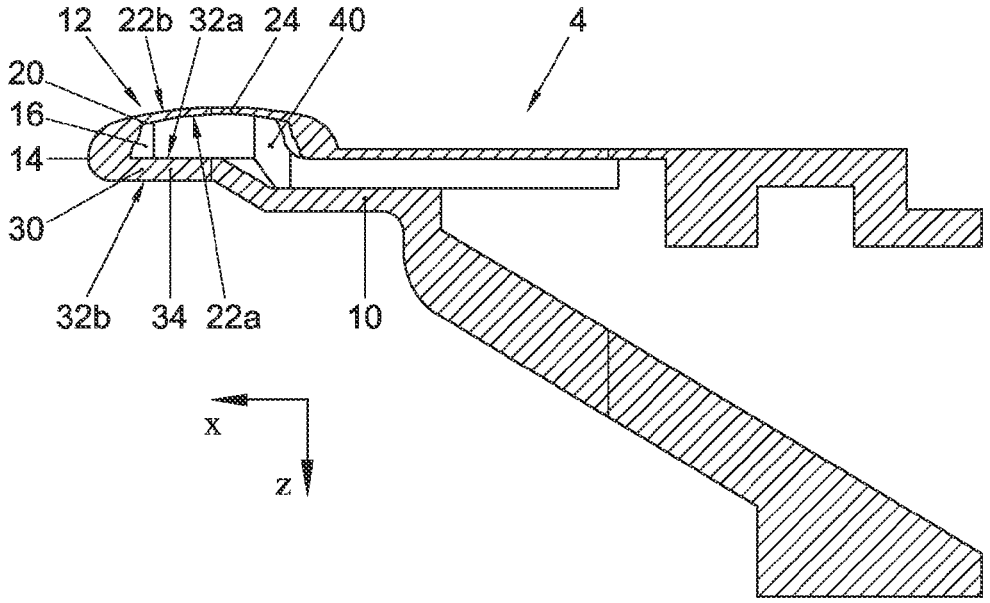
FIG. 8 is a schematic cross-sectional side view of a blade set including the alternative embodiment of the stationary blade shown in FIG. 7.

The second, outer surface 22*b* of the first wall 20 may provide for the skin-contacting surface of the stationary blade 10. In one embodiment the first wall 20, or at least (in particular the second surface 22*b* of) the portion thereof defining its projections 24, may be generally planar. See for example the embodiment of FIGS. 1-6. In another embodiment, such as the embodiment shown in FIGS. 7-8, the first wall 20, or at least (in particular the second surface 22*b* of) the portion thereof defining its projections 24, may be convexly curved. The convex curvature may be present in longitudinal cross-sections of the first wall 20, i.e. in cross-sectional planes perpendicular to the lateral direction (y), but, alternatively or in addition thereto, also in lateral cross-sections of the first wall 20, i.e. in cross-sectional planes perpendicular to the longitudinal direction (x). During use, when the skin-contacting second surface 22*b* is pressed against the flexible skin, a convex curvature of the second surface 22*b* of the first wall 20 provides for a more equal and therefore more comfortable pressure distribution across the skin than a planar second surface. This is in part because the convex curvature prevents high skin strain levels at the circumferential edge of the first wall as it avoids the necessity for the skin to bulge out from under this edge.

As regards the shape and form of the U-shaped teeth 12 of the stationary blade 10, the following may be noted. Facing and tip-connected projections 24, 34 of the first and second walls that define a certain U-shaped tooth 12 may preferably have a same length l and width w; as discussed above, their thicknesses $t_1$, $t_2$ may differ. In addition, the plurality of teeth 12 of the stationary blade 10 may preferably be substantially identical, and be arranged such that their tips 14 are linearly aligned. The length l and width w of the teeth 12 may vary between different embodiments. The stationary blade 10 shown in the embodiment of FIGS. 1-6, for instance has relatively short teeth 12, while the alternative embodiment shown in FIGS. 7-8 has relative long teeth 12. In preferred embodiments, the length l of the teeth 12 of the stationary blade may be in the range of 0.5-5 mm. The width w of individual teeth 12 may preferably be constant along their length, but need not be. In preferred embodiments of the stationary blade, an average width w of the teeth 12 may be in the range of 0.1-1 mm. The lateral spacing d between the teeth 12 may preferably be in the range of 0.2-1 mm. The tips 14 of the teeth 12 may preferably be convexly curved/rounded off, as seen in a longitudinal cross-section, so as to avoid cutting the skin during use. The minimum radius of curvature of the tip may preferably be 0.3 mm. Other sharp edges of the teeth 12, e.g. their longitudinally extending lateral edges, may be likewise rounded.

As regards the geometry of the stationary blade 10 as a whole, it is noted that the embodiments of FIGS. 1-8 all have a linear geometry. In another embodiment, however, such as that depicted in FIGS. 9-10, the stationary blade 10 may have a rotational geometry. In such an embodiment the guide slot 16 for the movable blade 40 of the blade set 4 may not extend linearly, as in the embodiments of FIGS. 1-8, but circularly around a central axis L of the blade 10 in a tangential direction t; in accordance therewith, the laterally/tangentially spaced apart U-shaped teeth 12 may all extend longitudinally in a generally radial direction r. It is understood that a matching movable blade 40 may have a circularly curved toothed leading edge, which may be received in the guide slot 16 to be driven in continuous rotational (instead of linearly reciprocating) motion around the central axis L.

Figure 9:
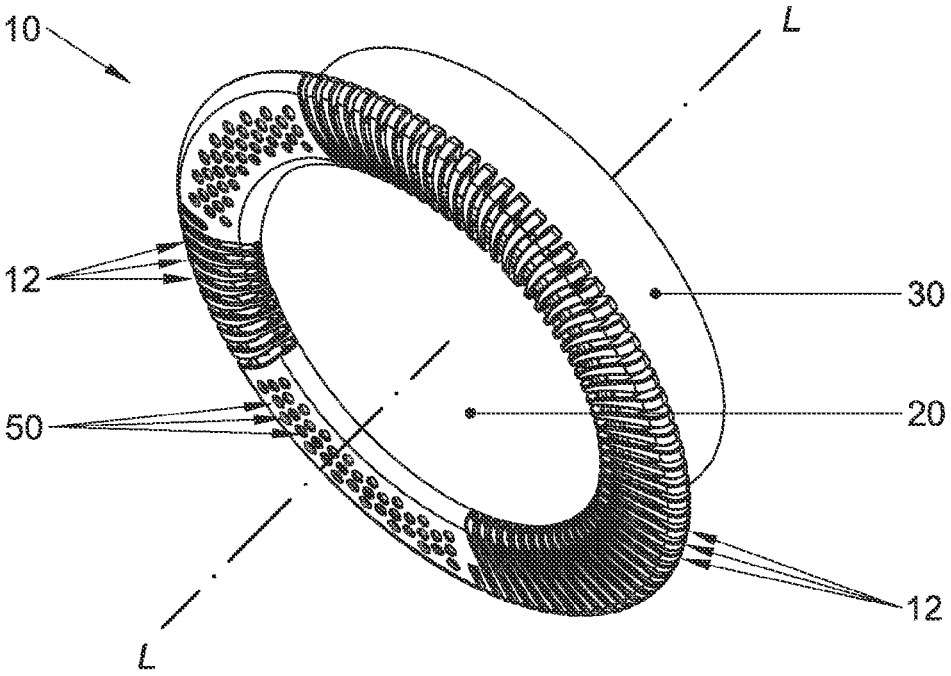
FIG. 9 is a schematic perspective bottom view of an embodiment of a stationary blade having a circular geometry.
Figure 10:
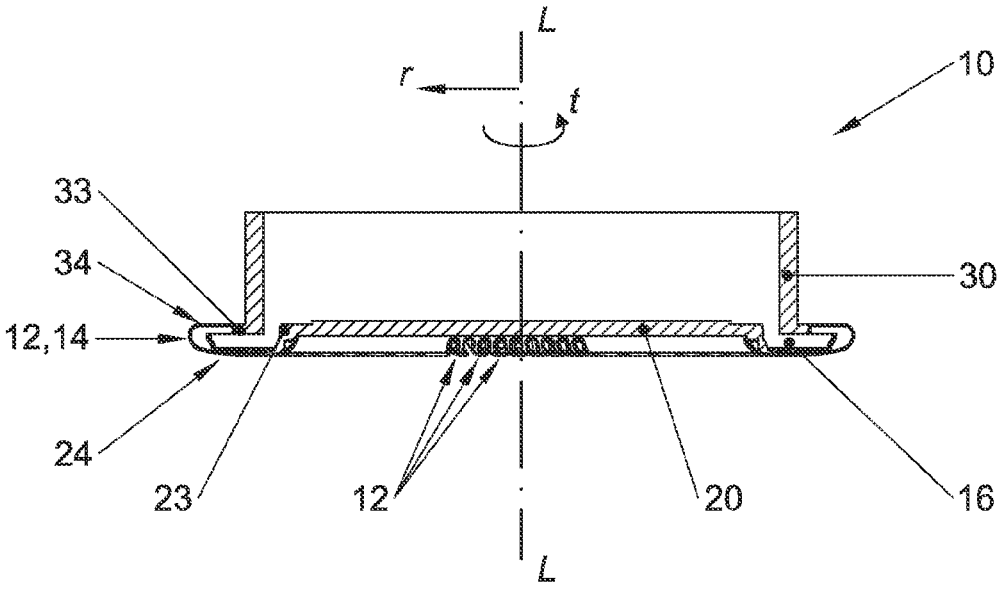
FIG. 10 is a schematic cross-sectional perspective view of the stationary blade shown in FIG. 9.

As in the embodiment of FIGS. 9-10, the circularly curved leading edges 23, 33 of the first and second walls 20, 30 need not provide for U-shaped teeth 12 along their entire circumferences. Instead, small stubble hair capturing holes 50 may be provided in/along at least one circumferential portion of the leading edge 23 of the first wall; a facing leading edge portion of the second wall may simply be closed. Accordingly, the stationary blade 10 may be configured to both capture relatively long hairs in between the U-shaped teeth 12, and short stubble hairs in the small holes 50.

In different embodiments, the stationary blade 10 may be manufactured from different materials and in different ways.

In a preferred embodiment, the stationary blade 10 may be at least partially made from sheet metal. In some embodiments the metal tips 14 of the U-shaped teeth 12 of the stationary blade 10 may be coated with a layer of plastic, e.g. through plastic micro molding, so as to round them off and provide them with a minimum, skin-comfortable radius that avoids skin cuts.

One method of manufacturing the stationary blade 10 may include (i) providing a metal plate, (ii) stamping a series of identical, longitudinally extending, laterally spaced apart slots into the plate, and (iii) folding/bending the plate into a U-shape along a laterally extending fold-line that extends through said spaced apart slots. It will be clear that, in this embodiment, the metal plate, which may but need not be of uniform thickness, provides for both the first wall 20 and the second wall 30 of the stationary blade 10, while the slots in the plate define the spacings between the teeth 12 of the blade. The fold-line may correspond to the line defined by the leading tips 14 of the U-shaped teeth 12.

Another method of manufacturing the stationary blade 10 may include (i) providing a first metal plate with a first laterally extending leading edge, (ii) providing a second metal plate similar in shape to the first and having a second laterally extending leading edge, and (iii) providing a metal strip having a lateral dimension that corresponds to that of the leading edges of the first and second metal plates and a longitudinal dimension that is significantly smaller than that of the first and second metal plates. The method may further include stacking the second metal plate on top of the first metal plate while arranging the metal strip in between their leading edges, such that a longitudinal cross-section of the stacked arrangement is generally U-shaped. The stacked arrangement may be fixed by welding the strip between the first and second leading edges. Then the welded leading edge of the arrangement may be rounded by means of electrochemical machining Subsequently, U-shaped teeth may be created by machining, e.g. wire-eroding, a plurality of laterally spaced apart slots into the leading edge of the arrangement, which slots may longitudinally extend beyond the strip. It is understood that, in this embodiment, the first metal plate may largely correspond to the first wall 20 of the stationary blade 10, while the second metal plate may largely correspond to the second wall of the stationary blade 10 (or, as in the embodiment of FIGS. 9-10, to a circumferential flange provided on the cylindrical portion of the second wall 30), and the metal strip may define the tips of the projections 26, 36 of both the first and second walls 20, 30.

Either method of manufacturing may further include the insertion of at least one connector portion 18 between opposing first and second walls of the U-shaped stationary blade 10, and welding the connector portion 18 thereto to fix it in place.

In addition to the stationary blade 10, the presently disclosed blade set 4 may further include a movable blade 40. The movable blade 40 may be configured to be laterally slidingly receivable inside the guide slot 16 defined by the stationary blade 10, and include a toothed leading edge 42 for linear reciprocating or continuous rotational motion within, and cutting cooperation with, the U-shaped teeth 12 of the stationary blade 10. In is understood that the toothed leading edge of the movable blade 40 may extend along a generally linear path in case the stationary blade 10 defines a linear guide slot 16 (cf. FIG. 1-8), while it may extend along a curved, in particular circular, path in case the stationary blade 10 defines a circular guide slot 16 (cf FIGS. 9-10). In particular in case the movable blade is configured for reciprocating linear motion, each of the teeth of the movable blade 40 may preferably have two lateral cutting faces, and the number of teeth on the movable blade may typically be smaller than the number of U-shaped teeth 12 on the stationary blade. To facilitate connection of the movable blade 40 to the electric motor within the housing 2 of the hair cutting appliance 1, the movable blade 40 may be connected to a blade stem 44.

In the depicted embodiments of FIGS. 1-8, the movable blade 40 is effectively form-locked between the first, inner surfaces 22*a*, 32*a* of the first and second walls 20, 30 of the stationary blade 10; i.e. the inner surfaces 22*a*, 32*a* of the walls 20, 30 snugly enclose the movable blade 40 and confine it to lateral sliding movement between them. In an alternative embodiment, the movable blade 40 may be force-locked instead of form-locked. That is, the movable blade 40 may be slidingly received in the guide slot 16 between the inner surfaces 22*a*, 32*a* of the stationary blade 10, which guide slot 16 may have a height that well exceeds the height/thickness of the movable blade 40. To ensure that the movable blade is forced into (slidable) contact with the inner surface of 22*a* of the first wall 20, a mechanical spring may be provided, e.g. a compression spring disposed between the housing 2 of the hair cutting appliance 1 and the blade stem 44.

Although illustrative embodiments of the present invention have been described above, in part with reference to the accompanying drawings, it is to be understood that the invention is not limited to these embodiments. Variations to the disclosed embodiments can be understood and effected by those skilled in the art in practicing the claimed invention, from a study of the drawings, the disclosure, and the appended claims. Reference throughout this specification to "one embodiment" or "an embodiment" means that a particular feature, structure or characteristic described in connection with the embodiment is included in at least one embodiment of the stationary blade, blade set, etc. according to the present disclosure. Thus, the appearances of the phrases "in one embodiment" or "in an embodiment" in various places throughout this specification are not necessarily all referring to the same embodiment. Furthermore, it is noted that particular features, structures, or characteristics of one or more embodiments may be combined in any suitable manner to form new, not explicitly described embodiments.

LIST OF ELEMENTS

1 hair cutting appliance
2 housing
4 blade set
10 stationary blade
12 U-shaped tooth
14 (leading) tip of U-shaped tooth
16 guide slot for movable blade
18 connector portion between first and second walls
20 first, skin-contacting/facing wall
22*a,b* first, inner surface (a) and second, outer surface (b) of first wall
23 leading edge of first wall
24 projections of first wall
26 tips of projections of first wall
30 second wall
32*a,b* first surface (a) and second surface (b) of second wall
33 leading edge of second wall
34 projections of second wall
36 tips of projections of second wall
40 movable blade
42 toothed leading edge
44 stem, connecting to motor
46 recess in movable blade for connector portion 18
50 hair capturing hole in leading edge of second wall
d spacing between adjacent U-shaped teeth
l length of U-shaped tooth
L central axis of stationary blade with circular geometry
$t_1$ thickness of first wall
$t_2$ thickness of second wall
w width of U-shaped tooth
x,r longitudinal, radial direction
y,t lateral, tangential direction
z height/thickness direction

The invention claimed is:

1. A method of manufacturing a stationary blade of an electrically operated hair cutting appliance, the method comprising acts of:

providing a first metal wall with a first laterally extending leading edge, and having a first surface and a second surface;

providing a second metal wall having a second laterally extending leading edge, and having a further first surface and a further second surface;

providing a metal strip having a lateral dimension that corresponds to that of the first and second laterally extending leading edges of the first and second metal wall;

forming a stacked arrangement by stacking the second metal wall on top of the first metal wall, wherein the first surface and the further first surface face each other, at least at the first and second laterally extending leading edges, and arranging the metal strip in between the first and second laterally extending leading edges, such that a longitudinal cross-section of the stacked arrangement of the stationary blade is generally U-shaped;

fixing the stacked arrangement by fixing the metal strip between the first and second laterally extending leading edges to mutually connect the first and second laterally extending leading edges; and creating generally U-shaped teeth by forming a plurality of laterally spaced apart slots into a leading edge of the stacked arrangement, such that said slots extend longitudinally beyond the metal strip, wherein the first surface of the first metal wall and the further first surface of the second metal wall in the stacked arrangement define a guide slot for insertion of a movable blade of said blade set between the first surface and the further first surface, and wherein the first laterally extending leading edge has an average thickness that is less than an average thickness of the second laterally extending leading edge.

2. The method of claim 1, wherein a longitudinal dimension of the metal strip is smaller than that of the first and second metal walls.

3. The method of claim 1, wherein the act of fixing the stacked arrangement by fixing the metal strip between the first and second laterally extending leading edges includes welding the metal strip between the first and second laterally extending leading edges.

4. The method of claim 1, wherein the act of creating generally U-shaped teeth by forming the plurality of laterally spaced apart slots into the leading edge of the stacked arrangement includes machining the plurality of laterally spaced apart slots into the leading edge of the stacked arrangement.

5. The method of claim 1, wherein a longitudinal dimension of the metal strip is smaller than that of the first and second metal walls, wherein the act of fixing the stacked arrangement by fixing the metal strip between the first and second laterally extending leading edges includes welding the metal strip between the first and second laterally extending leading edges, and wherein the act of creating generally U-shaped teeth by forming the plurality of laterally spaced apart slots into the leading edge of the stacked arrangement includes machining the plurality of laterally spaced apart slots into the leading edge of the stacked arrangement.

* * * * *